US007128190B2

(12) United States Patent
Kostka et al.

(10) Patent No.: US 7,128,190 B2
(45) **Date of Patent: *Oct. 31, 2006**

(54) ZONALLY OPERATED ELEVATOR INSTALLATION AND METHOD FOR CONTROL THEREOF

(75) Inventors: Miroslav Kostka, Ballwil (CH); Kurt Steinmann, Rotkreuz (CH)

(73) Assignee: Inventio AG, Seestrasse (CH)

( * ) Notice: Subject to any disclaimer, the term of this patent is extended or adjusted under 35 U.S.C. 154(b) by 392 days.

This patent is subject to a terminal disclaimer.

(21) Appl. No.: 10/733,001

(22) Filed: Dec. 10, 2003

(65) Prior Publication Data

US 2004/0163895 A1 Aug. 26, 2004

(30) Foreign Application Priority Data

Dec. 13, 2002 (EP) ..... 02406100

(51) Int. Cl.
*B66B 1/20* (2006.01)

(52) U.S. Cl. ..... 187/383; 187/247

(58) Field of Classification Search ..... 187/380–389, 187/247, 248

See application file for complete search history.

(56) References Cited

U.S. PATENT DOCUMENTS

| | | | | |
|---|---|---|---|---|
| 4,838,385 | A | 6/1989 | Ekholm | |
| 5,020,642 | A * | 6/1991 | Tsuji | 187/382 |
| 5,719,360 | A * | 2/1998 | Davis et al. | 187/383 |
| 5,773,772 | A * | 6/1998 | McCarthy et al. | 187/289 |
| 6,871,727 | B1 * | 3/2005 | Jokela et al. | 187/383 |
| 2005/0077115 | A1 * | 4/2005 | Urata | 187/383 |
| 2005/0087402 | A1 * | 4/2005 | Haegi et al. | 187/383 |

FOREIGN PATENT DOCUMENTS

WO WO 02 14198 2/2002

OTHER PUBLICATIONS

Patent Abstracts of Japan, vol. 017, No. 343 (M-1436), Jun. 29, 1993 & JP 05 043142 A (Fujitsu Ltd), Feb. 23, 1993 *Abstract*.
Patent Abstracts of Japan, vol. 018, No. 245 (M-1603), May 11, 1994 & JP 06 032544 A (Toshiba Corp), Feb. 8, 1994 *Abstract*.

* cited by examiner

*Primary Examiner*—Jonathan Salata
(74) *Attorney, Agent, or Firm*—Klaus P. Stoffel; Wolff & Samson PC

(57) ABSTRACT

A method for controlling a zonally operated elevator installation, wherein on a changeover floor changing between zones is made possible, and wherein with a delivering elevator group and a collecting elevator group transportation to and from the changeover floor is realized, and wherein a trip destination is entered via a destination-call control by each passenger to be transported. An elevator installation for zonal operation in buildings with several elevators, wherein each elevator group contains at least one destination-call input device for registering the destination of a passenger. Each elevator is assigned to an elevator group, the building is divided into zones, and a changeover floor for changing between the elevator groups is arranged between the zones. The delivering elevator group and the collecting elevator group are combined into a multi-group which is controlled by a multi-group control. Using the trip-destination entries and a statistics unit, the number of passengers who will change from the elevator group on the changeover floor is determined by the multi-group control. The elevator groups are controlled by the multi-group control depending on the number of changing passengers.

16 Claims, 3 Drawing Sheets

ZONALLY OPERATED ELEVATOR INSTALLATION AND METHOD FOR CONTROL THEREOF

BACKGROUND OF THE INVENTION

The invention relates to a method for controlling a zonally operated elevator installation, wherein on a changeover floor changing between the zones is made possible, and wherein with a delivering elevator group and a collecting elevator group, transportation to and from the changeover floor is realized, and further wherein a trip destination is entered via a destination-call control by each passenger to be transported. The invention further relates to an elevator installation for zonal operation in buildings with several elevators, wherein each elevator group contains at least one destination-call input device for registering the destination of a passenger. Each elevator is assigned to an elevator group, the building is divided into zones, and a changeover floor for changing between the elevator groups is arranged between the zones.

To meet the increasing need for transportation in tall buildings, intelligent elevator controls are used. For this purpose, the building is divided vertically into 2 or more zones or floor areas. In each of these zones, one or more elevator groups can be provided to allow transportation, especially of passengers. As soon as it is necessary to change elevators to reach a higher floor area, if the incidence of traffic is high, queues can form on the changeover floors. These queues are caused mainly by unequal transportation capacities of the delivering and collecting elevator groups.

An elevator control is a central system in which the operating processes are controlled by an intelligent station in the elevator system. This elevator control can be located in the machine room, or inside or outside the elevator cars.

The changeover floors between the zones, or between two zone systems, are also referred to as sky lobbies. The problem of possible overfilling of the changeover floor can also arise when changing between zone systems.

Elevators in very tall buildings occupy a significant part of the cross-section of the building. The amount of space available on the changeover floors is usually limited, and cannot be increased without very great constructional and financial outlay.

To effectively utilize these limited capacities on the changeover floors, use is known of devices for automatically detecting when the changeover floor is fully occupied. For this purpose, space monitoring devices such as light barriers, movement sensors, cameras, etc. are used. However, these devices provide only inexact information concerning occupation of the changeover floors. Furthermore, with these devices it is only possible to reduce or optimize the delivering transportation, and thereby avoid overfilling of the changeover floor and even greater delay in the transportation of passengers, at the cost of the overall transportation volume.

WO 02/14198 describes an elevator system in which group controls are used. The group controls use light barriers or weight sensors to record the number of persons. With this system, no exact forecast can be made of where the individual passengers travel to, or how many passengers are present on the changeover floor and when.

With the measures known to date, it cannot be determined whether all the persons detected on the changeover floors want to use the connecting elevators of the upper or lower zone, or whether they leave the elevator lobby or changeover floor for the purpose of visiting offices, restaurants, conference halls, etc. located on that floor.

The solutions for preventing or limiting overfilling of the changeover floor or sky lobby known to date aim either to reduce the transportation capacity of the delivering elevator group, which at times of peak load contraproductively causes transportation peaks, or else propose measures for increasing the transportation capacity of the collecting elevator group which in practice can only be realized to a limited extent. Such measures may include, for example, increasing the speed or acceleration, or shortening the door-open times. However, in respect of motor rating and power supply, elevators are usually not overdimensioned, so that increasing their speed or acceleration can only be considered to a very limited extent. Moreover, increasing the acceleration negatively affects how passengers experience the ride, so that here also, only a very limited increase in the transportation capacity can be achieved. Shortening or optimization of the door-opening times is implemented as standard on most elevators. These measures do not allow any really noticeable increase in the transportation capacity to be achieved.

SUMMARY OF THE INVENTION

Accordingly, it is an object of the present invention to reduce the above-mentioned disadvantages by creation of an elevator installation which allows an increase in the transportation capacity of the collecting elevator group, without reducing the transportation capacity of the delivering elevator group.

According to the present invention, the problems and shortcomings of the elevator controls according to the state of the art are solved by means of a method of controlling an elevator installation operated zonally, wherein changing between the zones on a changeover floor is made possible, and wherein transportation to and from the changeover floor respectively is realized by means of a delivering elevator group and a collecting elevator group. A trip destination is entered via a destination-call control by every passenger to be transported. The delivering elevator group and the collecting elevator group are combined into a multi-group which is controlled by a multi-control. The number of passengers who will change elevator group on the changeover floor is determined by the multi-group control from the trip destinations input by the passengers. The elevator groups are controlled by the multi-group control depending on the number of passengers changing.

Destination-call controlled elevators allow the possibility of using the information entered into the elevator system through the destination-call control to optimize the transportation capacity. Combining delivering and collecting elevator groups into a multi-group combined with a destination-call control makes it possible to determine the exact number of persons present on the changeover floor at any time. In consequence, the elevator groups can be controlled depending on the number of passengers on the changeover floor, which allows overfilling of the changeover floor to be avoided or limited.

For this purpose, according to the invention it is proposed to activate the reserves in the transportation capacity in advance, with the result that overfilling of a changeover floor by a continuous flow of arriving passengers occurs later or, should the flow diminish, not at all.

By means of the multi-group control it is possible to communicate to the changing passengers which elevator should be used first, and to communicate to the passengers in advance, before their arrival at the changeover floor, which elevator has been assigned as the best connecting elevator.

A statistics unit is provided in an advantageous embodiment of the invention. The statistics unit receives from the multi-group control, already when each changing passenger enters their first destination call, information as to the approximate time of arrival at the changeover floor. The multi-group control also transmits to the statistics unit the approximate boarding time. The exact boarding time is communicated after boarding has taken place. When the exact exiting time of the changing passengers on the changeover floor is known, this, together with the approximate time for boarding the connecting elevator, is communicated to the statistics unit VSE. As soon as the exact time of arrival of the connecting elevator is known, the multi-group control informs the statistics unit of the exact time of boarding the connecting elevator. This allows the statistics unit to maintain a future-oriented occupation statistic of the changeover floor, which is constantly made more precise with the notification of the exact arrival and departure times of each passenger.

Additionally, in an advantageous embodiment of the invention, the statistic of the occupation trend is maintained by the statistics unit. The positive or negative change in the number of persons on the changeover floor per interval of time is calculated. The statistics unit can use the approximate parameters to calculate a leading occupation of the changeover floor and a leading occupation trend. The statistic of the occupation trend complements the information regarding the number of passengers on the changeover floor, so that the correct conclusions regarding the development of the future occupation of the changeover floor can be drawn. By means of the leading statistic, the transportation capacity can be adapted in good time to the increasing or decreasing number of passengers on the changeover floor.

By the use of building-specific parameters, when a threshold value of the transportation capacity is exceeded, the transportation capacity of the collecting elevator group can be increased. When this is done, the transportation capacity of the delivering group is kept unchanged, the building is optimally filled or emptied, and the changeover floor is not overfilled.

As soon as occupation of the changeover floor decreases, and the parameter value falls below another threshold value, and the trend of occupation points downward, the destination-call control parameters are reset to normal values, so that the passenger comfort is optimally set again with sufficient transportation capacity. These different threshold values allow realization of a hysteresis, so that a stable control process can be assured.

The above measures cause only small reductions in the otherwise high convenience of a destination-call control. This manifests itself as full utilization of the car capacity and optimization of the waiting time depending on the time of arrival of the delivering elevator group. With the given peak load, the time to destination remains optimal for the totality of the changing passengers.

The purpose is also fulfilled by an elevator installation for zonal operation in buildings with several elevators, wherein each elevator contains a destination-call input device for registering the trip destination of a passenger. Each elevator is assigned to an elevator group, the building is divided into zones, and a changeover floor is arranged between the zones for changing between the elevator groups. A multi-group control for controlling a delivering elevator group and a collecting elevator group is provided to calculate from the trip-destinations input by the passengers in the delivering elevator group and by the passengers in the collecting elevator group the number of passengers on the changeover floor. The destination-call control parameters can be changed depending on the number of passengers on the changeover floor.

It is assumed that the expert reader recognizes that delivering and collecting elevator groups can be exchanged depending on their direction of travel. In the interest of greater clarity and comprehensibility, the invention is only described in relation to the direction of travel from the bottom to the top of the building.

These aspects and advantages of the present invention, as well as others, will become apparent from the following description of the preferred embodiments which refer to the accompanying drawings.

BRIEF DESCRIPTION OF THE DRAWINGS

The invention is explained in greater detail by reference to drawings representing only one direction of embodiment as follows.

DETAILED DESCRIPTION OF THE INVENTION

Figure 1:
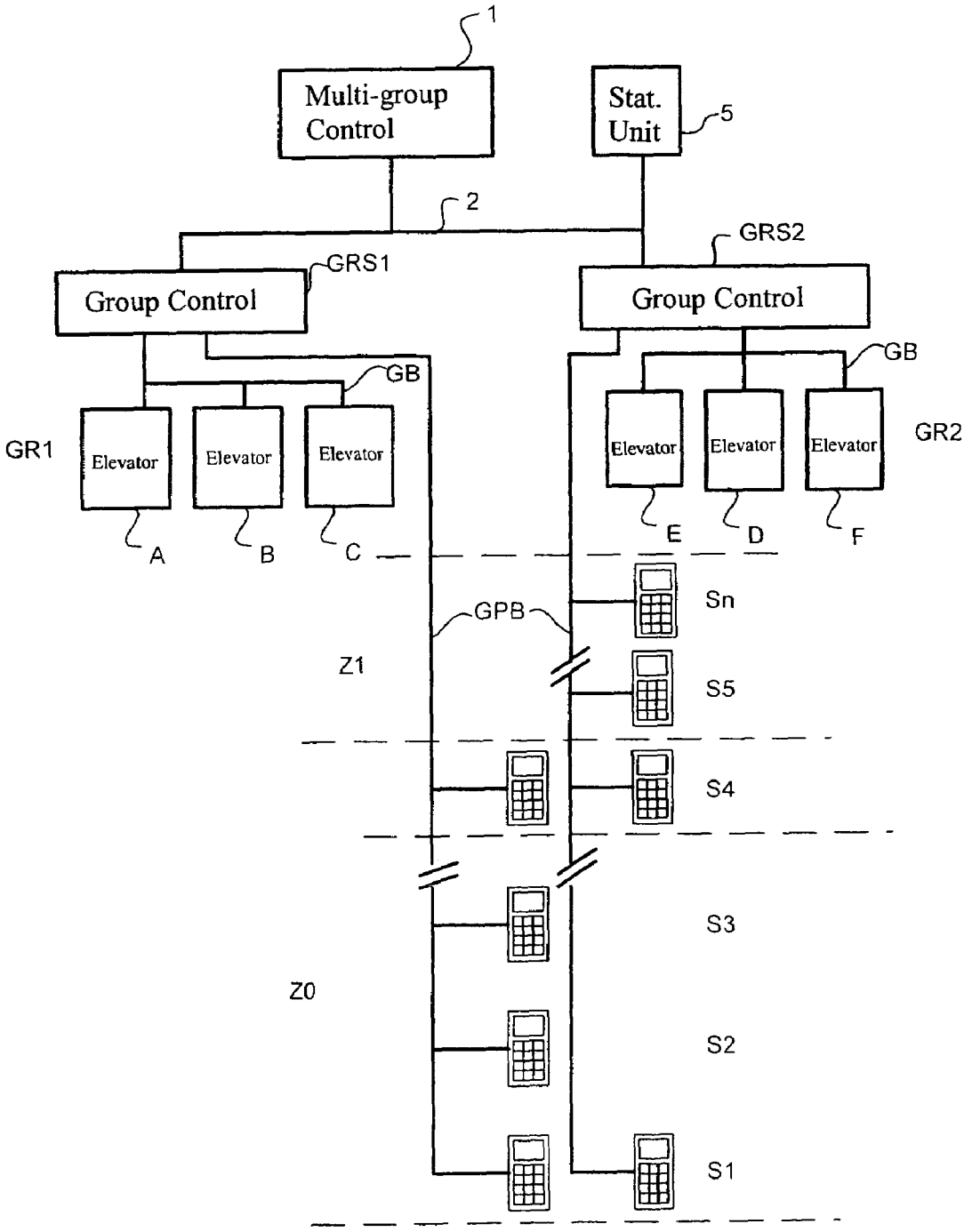
FIG. 1 a diagrammatic representation of an elevator installation with zonal operation.

FIG. 1 shows diagrammatically the construction of an elevator installation. The building is divided into several zones, Z1, Z0. Each zone comprises several floors. Zone Z0 comprises floors S1 to S4, and zone Z1 comprises floors S4 to Sn. In these zones, the elevators A–F are used for the transportation of passengers. The elevators A–F are divided into elevator groups GR1 and GR2. The elevators are controlled via a destination-call control device ZEG (not shown). The elevator group GR1 transports the passengers in zone Z0 from floor S1 to S4, and the elevator group GR2 transports the passengers in zone Z1 from floor S4 to Sn. It is also possible to reach floor S1 with the elevator group GR2. The elevators of the first elevator group GR1 are controlled by group controls GRS1, and group controls GRS2 control the elevators of the second elevator group GR2. The elevators are connected via a group bus GB to the group controls GRS1 and GRS2, respectively. The individual floors are connected to the group controls via a group peripheral bus GPB. For the purpose of controlling the elevator installation according to the invention, a multi-group control 1 is provided. This is connected via a multi-group bus 2 to the group controls GRS1 and GRS2. Also connected via the multi-group bus 2 is a statistics unit 5. In this embodiment, the floor S4 is a changeover floor or sky lobby, since changing between the zones of the building is made possible there.

Figure 2:
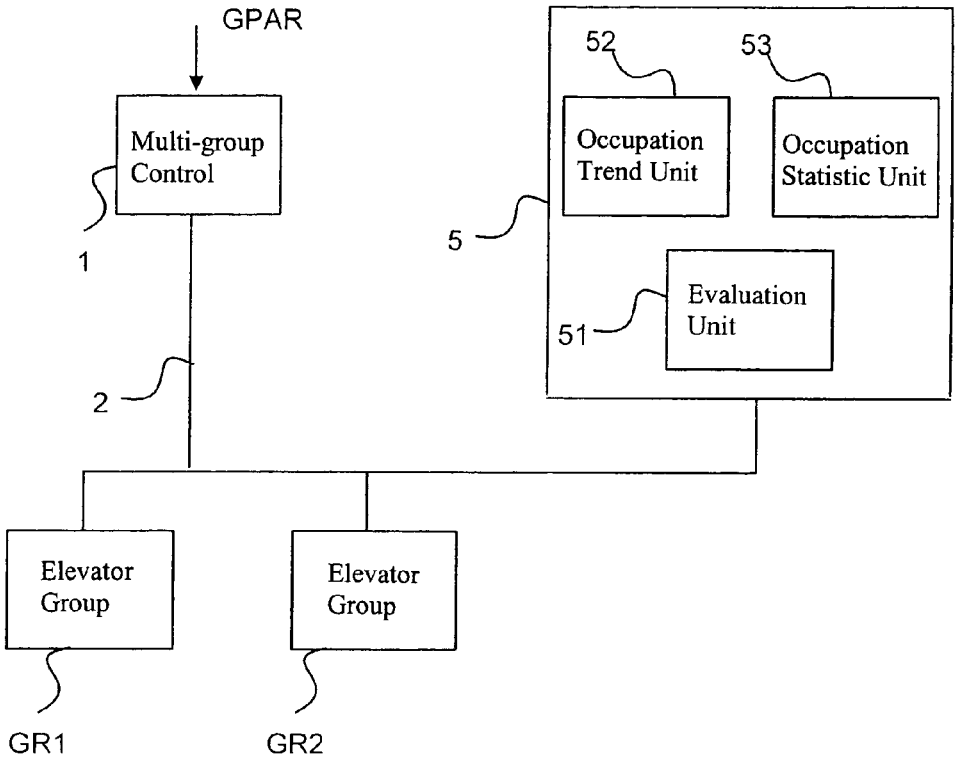
FIG. 2 a diagrammatic construction of the control for an elevator installation.

FIG. 2 shows a detailed diagrammatic representation of the control. Building parameters GPAR are fed to the multi-group control 1. These building parameters GPAR can include characteristics of the elevator as well as conditions on the changeover floors. Connected via the multi-group bus 2 are the group controls GRS1 and GRS2, and the statistics unit 5 is also connected to the multi-group control 1. The statistics unit 5 comprises an evaluation unit 51, a unit for determining the occupation trend 52, and a unit for determining the occupation statistic 53.

The functioning of the invention is explained below by reference to the exemplary embodiment represented in FIGS. 1 and 2.

From the delivering elevator group (A,B,C) and the collecting elevator group (D,E,F) a multi-group is formed. Through the combination, the multi-group control 1 detects by means of the destination-call control how many of the passengers must change elevators at the changeover floor S4. The multi-group control 1 detects whether a passenger has as a final destination a floor higher than S4, or whether the passenger may possibly visit a lecture theater, a restaurant, etc. and therefore not need to be regarded as filling the elevator lobby.

The multi-group control 1 first communicates to the changing passengers the elevator A,B,C to be used. Further, the best connecting elevator D,E,F is also communicated to the passengers in advance, before arrival at the changeover floor S4. A statistics unit 5 is also provided. The statistics unit 5 receives from the multi-group control 1, already when each changing passenger enters their first destination call, information as to the approximate time of arrival AAZ at the changeover floor S4. As soon as the exact exiting time GAZ of the changing passengers on the changeover floor becomes known, it is communicated to the statistics unit 5 together with the approximate time of boarding AEZ the connecting elevator D,E,F. As soon as the exact time of arrival GAZ of the connecting elevator D,E,F becomes known, the multi-group control 1 communicates the exact boarding time GEZ to the statistics unit 5. By this means, the statistics unit 5 can maintain a future-oriented occupation statistic for the changeover floor, which is constantly made more precise by the messages regarding the exact times of arrival and departure of each passenger. An occupation trend BT is also registered by the statistics unit 5. The positive or negative change in the number of persons on the changeover floor S4 per time interval is determined. The statistic regarding the occupation trend complements the information about the number of passengers on the changeover floor S4, so as to enable the correct conclusions regarding the development of the future occupation of the changeover floor to be drawn. In the statistics unit 5, two parameters MAXAPE (maximum number of passengers on the changeover floor: switch the increased transportation capacity on) and MAXAPA (maximum number of passengers on the changeover floor: switch the increased transportation capacity off) are used. The two values must be selected individually for each building and changeover floor, because they depend on the respective architectural solution of the elevator lobbies, and on the possible difference in the transportation capacities between the delivering and collecting elevator groups. Each of these two parameters MAXAPE, MAXAPA specifies a number of persons. If the occupation statistic maintained by the statistics unit 5 reaches a value which follows immediately after the parameter MAXAPE, and if the momentary occupation trend shows a corresponding positive gradient, the destination-call control parameters of the collecting elevator group (D,E,F) are automatically adapted by the multi-group control 1 in such manner that the maximum transportation capacity of this collecting elevator group is activated. This is also referred to as peak traffic mode. The transportation capacity of the delivering group is maintained, the building is optimally filled, and by exchanging the delivering elevator group A,B,C and collecting elevator group D,E,F, emptied, and the changeover floor is not overfilled.

The transportation capacity is achieved, for example, by full utilization of the maximum allowable number of persons. Furthermore, by corresponding time-related control of the collecting elevator group, in the case of impending overfilling, the maximum available transportation capacity for collection can be made available. For this purpose, for example, the elevators belonging to the collecting elevator group are preferably sent to the changeover floor, or the arrival time of the collecting elevators is adapted to the very full arriving, or delivering, elevators.

As soon as occupation of the changeover floor S4 falls, and the parameter value MAXAPA is reached, and the occupation trend points downward, the destination-call control parameters are reset to normal values or a normal traffic mode, as a result of which the passenger comfort is set optimally again with sufficient transportation capacity by the multi-group control 1. The parameter value MAXAPA typically lies above the value MAXAPE so as to assure a stable control process by means of the corresponding hysteresis.

Figure 3:
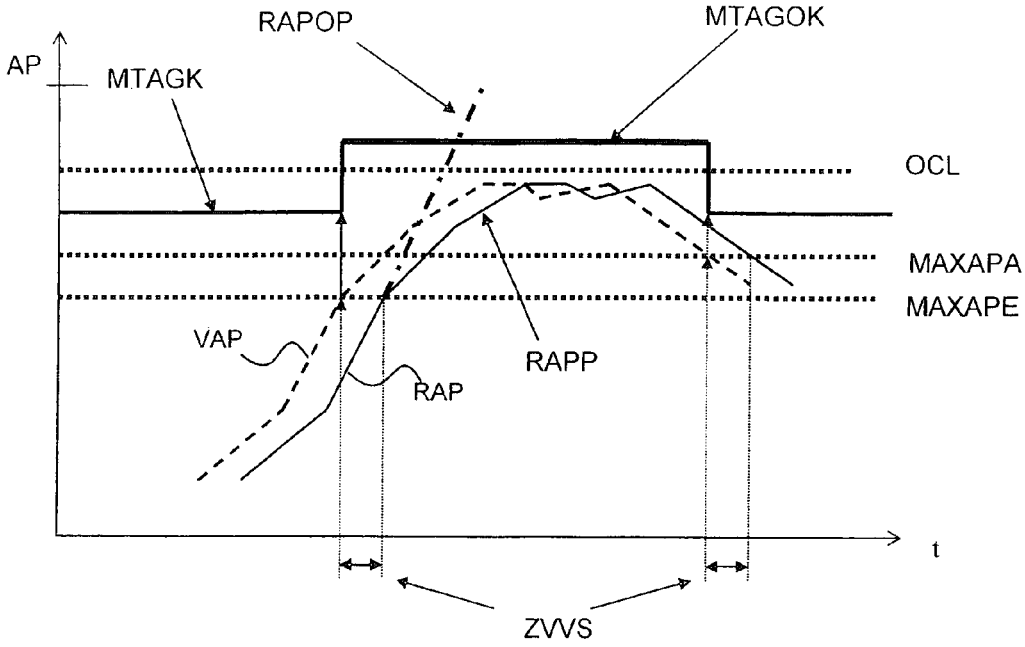
FIG. 3 a representation of the trend of occupation over time.

In FIG. 3, the increase in the number of persons AP on the changeover floor S4 is plotted against time t. Based on the calculation of the occupation statistic and the occupation trend of the respective units 52, 53 in the statistics unit 5, it is possible to create a leading statistic VAP.

By this means, a time-lead ZVVS necessary for prevention of overfilling is created. As the figure shows, the curve of the leading number of persons (VAP) matches almost exactly the real number of persons (RAP) with a displacement in time. With RAPP the curve of the number of persons on the changeover floor with changing parameters according to the invention is shown. Without the changing parameters, the number of persons would match the curve RAPOP, and very quickly lead to an overfilling of the changeover floor. When the parameter MAXAPE is exceeded with a rising occupation trend, the transportation capacity of the collecting elevator group is increased by, for example, fully utilizing the maximum allowable number of persons for each elevator, or by minimizing the number of stops. With MTAGK a transportation capacity is represented which offers maximum comfort for transportation of persons. After the change in the destination-call control parameters, the maximum transportation capacity with reduced comfort MTAGOK is activated. With this transportation capacity, more passengers can be transported away from the changeover floor. These changed destination-call control parameters are maintained until the number of persons on the changeover floor falls below the value of the parameter MAXAPA, and the occupation trend BT is also downward. The destination-control parameters are then reset to normal transportation capacity. Referenced with OCL is the threshold value for the number of persons on the changeover floor at which the changeover floor is overfilled.

Without further analysis, the foregoing will so fully reveal the gist of the present invention that others can, by applying current knowledge, readily adapt various applications without omitting features that, from the standpoint of prior art, merely constitute essential characteristics of the generic or specific aspects of this invention.

What is claimed is new and desired to be protected by Letters Patent as set forth in the appended claims:

1. A method for controlling a zonally operated elevator installation wherein on a changeover floor changing between zones is made possible, and by which transportation to and from the changeover floor is realized with a delivering elevator group and a collecting elevator group, and by which, a trip destination is entered via a destination-call control system by each passenger to be transported, the method comprising the steps of:

combining the delivering elevator group and the collecting elevator group into a multi-group which is controlled by a multi-group control;

determining a number of passengers who will change elevator groups on the changeover floor by the multi-group control using the trip destinations entered; and controlling the elevator groups by the multi-group control depending on the number of passengers changing.

2. the method according to claim 1, including communicating to the passengers an optimal elevator of an elevator group depending on the trip destination, and communicating an optimal connecting elevator on the changeover floor to the changing passengers by way of the multi-group control.

3. The method according to claim 1, including determining with the multi-group control a number of passengers who will not use any connecting elevator group, and feeding the number together with the number of changing passengers to a statistics unit.

4. The method according to claim 3, further including transmitting an approximate exiting time on the changeover floor to the statistics unit after a destination-call is entered.

5. The method according to claim 4, including transmitting an exact exiting time of the passengers on the changeover floor, and an approximate time of boarding the connecting elevator to the statistics unit.

6. The method according to claim 1, including transmitting, with the multi-group control, an exact time of boarding the connecting elevator to a statistics unit as soon as the exact time of boarding the connecting elevator is known.

7. The method according to claim 5, including determining, in the statistics unit from the determined times, the number of passengers on the changeover floor at any time.

8. The method according to claim 7, wherein the statistics unit determines from the exact times of boarding and exiting a real number of persons on the changeover floor, and from the approximate times of boarding and exiting a leading number of persons on the changeover floor.

9. The method according to claim 1, including feeding the building parameters to the multi-group control.

10. The method according to claim 1, including notifying the multi-group control when a parameter (MAXAPE) is exceeded,, and adjusting transportation capacity of the collecting elevator group by changing destination-call control parameters for the collecting elevator group.

11. The method according to claim 10, including adjusting the transportation capacity of the collecting elevator group by changing the destination-call control parameters for the collecting elevator group when the parameter (MAXAPE) is exceeded and an occupation trend has a positive gradient, and setting a maximum transportation capacity with reduced comfort (MTAGOK) for the collecting elevator group.

12. The method according to claim 11, including changing the destination-call control parameters to a normal transportation capacity with normal comfort when a parameter (MAXAPA) is fallen below and an occupation trend is negative.

13. The method according to claim 12, wherein the parameter MAXAPE has a value that is smaller than a value of the parameter MAXAPA.

14. The method according to claim 13, wherein the parameters MAXAPA and MAXAPE are adjustable.

15. An elevator installation for zonal operation in buildings, comprising:

several elevators, each elevator having at least one destination-call input device for recording a destination of a passenger, each elevator being assigned to an elevator group, the building being divided into zones, and arranged between the zones is a changeover floor for changing between the elevator groups; and a multi-group control for controlling a delivering elevator group and a collecting elevator group, the multi-group control being operative to calculate from the trip-destination entries of the passengers in the delivering elevator group and the passengers in the collecting elevator group a number of passengers on the changeover floor, destination-call control parameters being changeable depending on the number of passengers on the changeover floor.

16. The device according to claim 15, and further comprising a statistics unit, the multi-group control being assigned to the statistics unit so as to feed the parameters determined by the multi-group control to the statistics unit, the statistics unit being operative to calculate the number of persons on the changeover floor and an occupation trend on the changeover floor, the multi-group control being operable in a peak-traffic mode when a specifiable maximum parameter is exceeded, and in a normal-traffic mode when a further parameter is fallen below.

* * * * *